United States Patent [19]

Wackrow et al.

[11] Patent Number: 4,881,517

[45] Date of Patent: Nov. 21, 1989

[54] AIR GUNS

[75] Inventors: Roger D. Wackrow, Redditch; Harold C. Jones, Studley, both of England

[73] Assignee: BSA Guns (UK) Limited, Birmingham, England

[21] Appl. No.: 166,385

[22] Filed: Mar. 10, 1988

[30] Foreign Application Priority Data

Mar. 13, 1987 [GB] United Kingdom ..... 8705993

[51] Int. Cl.[4] ..... F41B 11/00

[52] U.S. Cl. ..... 124/65; 124/56; 124/63

[58] Field of Search ..... 124/64, 65, 66, 67, 124/68, 56, 72; 42/39.5

[56] References Cited

U.S. PATENT DOCUMENTS

| | | | |
|---|---|---|---|
| 841,815 | 1/1907 | Quackenbush | 124/67 |
| 1,148,297 | 7/1915 | Dickey | 124/56 |

FOREIGN PATENT DOCUMENTS

| | | | |
|---|---|---|---|
| 107670 | 6/1939 | Australia | 124/72 |
| 507487 | 9/1930 | Fed. Rep. of Germany | 124/67 |
| 918278 | 9/1945 | France | 124/67 |
| 10250 | of 1911 | United Kingdom | 124/67 |
| 250351 | 4/1926 | United Kingdom . | |
| 425755 | 3/1935 | United Kingdom | 124/56 |
| 799805 | 8/1958 | United Kingdom | 124/67 |

OTHER PUBLICATIONS

Abstract of British Pat. No. 13,567 accepted Mar. 8, 1909.

*Primary Examiner*—Randolph A. Reese
*Assistant Examiner*—Anthony Knight
*Attorney, Agent, or Firm*—Leydig, Voit & Mayer

[57] ABSTRACT

An air gun having a fixed barrel mounted on a body and a source of compressed air or gas housed in the body has a device for enabling a pellet to be inserted directly into the barrel. A breech block is angularly movable between a loading position in which the breech is exposed and a firing position in which the breech is closed, the breech block having passage for completing the connection between the breech and the source of compressed air. In the embodiment shown the breech block is cylindrical and is rotatably mounted in a continuation of a cylinder in which a spring urged piston works, and has a guide chute in its cylindrical surface to assist the introduction of the pellet. Seals may be provided at either end of the breech block.

17 Claims, 1 Drawing Sheet

AIR GUNS

This invention relates to air guns of the kind having a fixed barrel, that is to say a barrel which is fixed in relation to the body of the gun. The body houses the piston and cylinder or other source of compressed air or gas. The terms air and compressed air, as used hereinafter are intended to refer not only to air but to other gases to be used as propellants in air guns. The term air gun is intended to include both air rifles and air pistols.

The present invention consists in a fixed-barrel air gun having means for enabling a pellet to be inserted directly into the barrel and comprising a breech block which is angularly movable between a loading position in which the breech is exposed to enable a pellet to be inserted therein and a firing position in which the breech is closed, the breech block having a passage for completing a connection between the breech and the source of compressed air in the firing position but the breech block interrupting the connection in the loading position.

The breech block may have a gap through which a pellet can be inserted into the barrel, the gap being aligned with the barrel when the beech block is in the loading position. The gap in the breech block is preferably arranged as a guide chute shaped to facilitate the insertion of a pellet into the barrel.

An axis about which the breech block is angularly movable may be co-axial with, or parallel or inclined to the axis of the barrel. The breech block may be arranged for angular movement by being rotatably mounted in a bearing surface in the body. The outer surface of the breech block may be cylindrical and, when the source of compressed air is a piston and cylinder, the cylinder and bearing surface may be concentric but preferably the diameter of the cylinder in which the piston slides extends forwards to provide the rotary bearing surface for the breech block. Whether bearing surface and cylinder form one continuous surface or are co-axial but of different diameters, the breech block may serve also as a cylinder head and be provided at the rear end with a rotary seal where the breech block enters the cylinder.

There may be direct metal-to-metal contact between the forward end of the breech block and the barrel or a seal may be provided. The seal may be housed in an annular recess in the breech face of the barrel or in the forward end of the breech block and concentric with the axis of the barrel or the passage respectively. The seal may be an O-ring.

Means is preferably provided for limiting the angular movement of the breech block to movement between the loading and firing positions as extremes and for releasably retaining the breech block in the loading and firing positions.

An embodiment of the invention will now be described, by way of example, with reference to the accompanying drawings in which.

Figure 1:
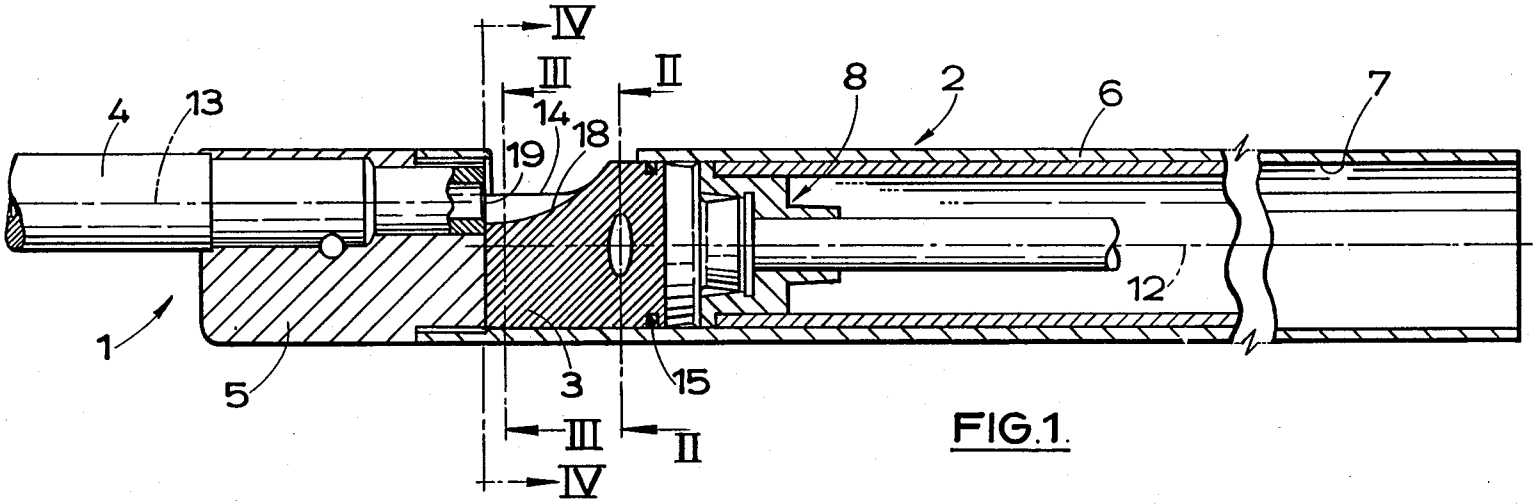
FIG. 1 is a longitudinal section through the breech region of an air rifle.

The air rifle shown in the drawings comprises a barrel assembly 1, a body 2 and a breech block 3. The barrel assembly 1 comprises a barrel mounted in a holder 5. The body 2 has an outer tube 6 the bore of which forms a cylinder 7 in which slides a hollow piston assembly 8.

A mainspring (not shown) engages the interior of the piston assembly and when compressed and released, urges the piston assembly to the left as viewed in FIG. 1 and towards the relative positions in which the components are shown in FIG. 1.

The forward end of the outer tube 6 is connected to the rear end of the holder 5, to secure the barrel assembly 1 to the body 2 with the axis 12 of the cylinder 7 below and parallel to the axis 13 of the bore of the barrel 4.

Figure 3:
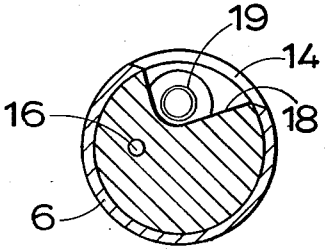

Near its forward end the top of the outer tube 6 has a cut-away 14 immediately behind the rear face of the barrel holder and extending circumferentially for an arc subtending an angle at the axis 12 of substantially 90°. As shown in FIG. 3 the cut-away 14 is asymmetrically arranged with respect to the central vertical plane of the rifle so as to have a larger opening to the right-hand side of the rifle than to the left.

The breech block 3 is a cylinder the diameter of which enables it to turn freely in the forward extension of the cylinder 7 which affords a rotary bearing surface for the breech block. Formation of the rotary bearing surface as a continuation, at the same diameter, of the cylinder 7 is convenient in manufacture as both surfaces can be machined and surface finished simultaneously. The length of the breech block 3 is greater than the axial extent of the cut-away 14. An O-ring seal 15 is fitted into a circumferential groove close to the rear end of the breech block which the cylinder 7 overlaps. The breech block 3 and seal 15 lie in and close the forward end of the cylinder 7 so that the breech block 3 forms a cylinder head.

Figure 2:
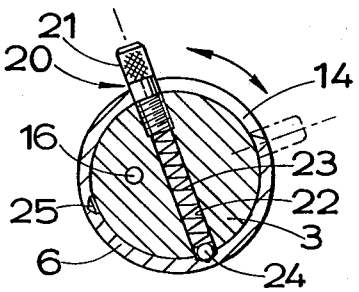

A small bore passage 16 (FIGS. 2 to 4) is bored right through the breech block parallel to the axis 12 and spaced from that axis a distance equal to the distance separating the axis 12 from the axis 13 of the bore of the barrel. In the front face of the breech block an annular recess is provided concentric with the passage 16 to receive an O-ring seal 17 (FIG. 4).

Figure 4:
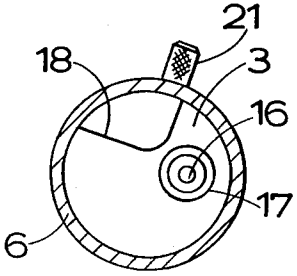
FIGS. 2, 3 and 4 are cross-sections on lines II—II, III—III, and IV—IV of FIG. 1.

Material of the forward portion of the breech block 3 spaced angularly from the passage 16 in an anti-clockwise direction as viewed in FIG. 4 is removed to form a guide chute 18 to facilitate the insertion of pellets into the barrel. The guide chute 18 leaves a gap in the cylindrical surface of the breech block and is deepest at the front face of the breech block and curves rearwards and upwards so as to extend about three-quarters of the length of the breech block to leave a full diameter rear portion of the breech block. At the forward end, the guide chute 18 is deep enough to expose the full diameter of the bore of the barrel at the breech face 19 when the breech block is in the loading position as shown in FIG. 3. The base of the guide chute 18 is curved transversely at the forward end and extends through an arc of about 90°. From the ends of the arc the walls of the guide chute extend tangentially with respect to the arc towards the block 3 but asymmetrically inclined towards the right, as viewed and shown in FIG. 3, when the breech block is in the loading position. In that position the widest part of the guide chute 18 then substantially coincides with the cut-away 14 and the base of the forward end of the guide chute lies just outside the bore of the barrel so as to assist the insertion of a pellet into the bore of the barrel. The 90° angular spacing in the breech block of the guide chute 18 from the passage 16 means that clockwise movement (as viewed in FIG. 3) of the breech block through about 90° from the loading position to the firing position moves the guide chute 18 away from the bore of the barrel so that the breech face 19 is covered by the front face of the breech block 3 apart from its connection to the cylinder by the passage 16 which is, in the firing position, aligned with the axis of the bore of the barrel. Means 20 is provided for facilitating the angular movement of the breech block, for limiting such movement to movement between the loading position and the firing position, and for releasably holding the breech block in each of these positions. The means 20 comprises a stud 21 screwed into a threaded end of a diametrical bore 22 through the rear part of the breech block 3, a ball 24 and a coil spring 23 in the bore 22, the spring 23 engaging the ball 24 at one end and the stud 21 at the other. When the stud 21 is tightened in the screw thread it compresses the spring 23, and the ball is urged into contact with the surrounding forward extension of the cylinder 7. Depressions 25 are formed in the wall of the extension of the cylinder 7 to receive the ball 24 in the loading and firing positions, releasably holding the breech block in each of these positions. Part of the stud 21 projects radially from the breech block to provide an arm enabling the breech block to be angularly moved by hand. The arrangement is such that in the loading and firing positions the stud 21 engages locally relieved portions of the edges of the cut-away 14 limiting angular movement of the breech block to movement between these extremes. By engaging the rear edge of the cut-away 14 the stud 21 also serves to prevent rearward movement of the breech block into the cylinder 7. The breech block 3 can be allowed some free axial movement, so that it is easy to move angularly, without impairing the seal between its forward face and the breech face. This is because the rear face of the breech block is subjected to the full pressure of air within the cylinder 7 when the rifle is fired. The air pressure urges the front face of the breech block towards the breech face increasing the sealing pressure on the O-ring seal 17 around the forward end of the passage 16.

During movement of the breech block 3 between the firing and loading positions the front face of the O-ring seal 17 slides over the breech face. Axial pressure on the O-ring seal 17 when such movement takes place can be very light because of the axial freedom allowed the breech block when air in the cylinder 7 is not under pressure. The construction of the rifle allows the risk of damage to the O-ring seal 17 to be further reduced in that the breech face of the barrel 2 and barrel holder 5 can be machined after assembly of the barrel in the holder 5, enabling a flat surface to be produced with the barrel end flush with the surrounding face of the holder. The tapering entrance to the barrel, the barrel lead, can also be machined at this stage and thus can be very accurately positioned and formed.

When the rifle is to be used, it is first cocked by manipulating a cocking lever (not shown) in the usual way to compress the main spring and retract the piston assembly 8 which is retained in the cocked position by a trigger-actuated sear (not shown). The breech block 3 is then turned to the loading position, a pellet inserted down the guide chute 18 into the barrel and the breech block returned to the firing position. Pressure on the trigger withdraws the sear and releases the spring-loaded piston assembly compressing air in the cylinder 7. Air under high pressure passes through the passage 16 to propel the pellet from the barrel.

In a modification the breech block is provided with a return spring to return it to the loading position after the rifle has been fired. The return spring may be a torsion spring recessed between the breech face of the barrel and the breech block. The ends of the torsion spring are cranked to engage holes in the breech face and the breech block. The spring is tensioned by turning the breech block manually to the firing position and may be arranged to be released to open the breech by cocking the rifle.

We claim:

1. An air gun comprising a body which houses a source of compressed gas, a barrel which is fixed in relation to said body and which has a bore extending forward from a bore entry at a rear end of said barrel, and a breech block mounted rearwardly of and adjacent to said bore entry, said block being shaped externally to form a guide chute and having a through passage separate from said chute, said breech block being angularly movable between a loading position in which said guide chute is aligned with said bore entry and said entry is exposed for a pellet to be inserted manually into position in said entry and a firing position in which said guide chute is displaced from said entry and said through passage is aligned with said entry and completes a connection for gas between said source of compressed gas and said entry, said passage not being aligned with said entry and not communicating with said entry when said breech block is in said loading position.

2. An air gun according to claim 1, in which the chute has a deeper portion adjacent the barrel and a shallower portion spaced from the barrel.

3. An air gun according to claim 1, in which when the breech block is in the loading position the forwardmost part of the base of the chute adjacent the barrel registers with, or is just below, the lower edge of the bore of the barrel.

4. An air gun according to claim 1, in which the breech block is rotatably mounted in a bearing surface in the body.

5. An air gun according to claim 1, in which there is direct metal to metal contact between the forward end of the breech block and the barrel.

6. An air gun according to claim 1, in which a seal is provided between the forward end of the breech block and the barrel.

7. An air gun according to claim 6, in which the seal is housed in an annular recess in the breech face of the barrel, concentric with the axis of the barrel.

8. An air gun according to claim 6, in which the seal is housed in an annular recess, in the forward end of the breech block, concentric with the axis of the passage.

9. An air gun according to claim 1, in which means is provided for limiting the angular movement of the breech block to movement between the loading and firing positions as extremes.

10. An air gun according to claim 1, in which means is provided for releasably retaining the breech block in the loading and firing positions.

11. An air gun according to claim 1, in which the source of compressed gas comprises a reciprocally movable piston within a cylinder.

12. An air gun according to claim 11, in which the breech block has a central longitudinal axis which is concentric with the axis of the cylinder and in which the diameter of the cylinder in which the piston slides extends forwards to provide a rotary bearing surface for the breech block.

13. An air gun according to claim 11, in which the breech block serves as a cylinder head.

14. An air gun according to claim 13, in which the breech block is provided at its rear end with a rotary seal where the breech block enters the cylinder.

15. An air gun according to claim 1, in which the axis about which the breech block is angularly movable is parallel to the axis of the barrel.

16. An air gun according to claim 1, in which the axis about which the breech block is angularly movable is co-axial with the axis of the barrel.

17. An air gun comprising a body which houses a piston reciprocable in a cylinder bore defined in said body to provide a source of compressed gas, a barrel which is fixed in relation to said body and which has a bore extending forward from a bore entry at a rear end of said barrel, and a breech block mounted rearwardly of an adjacent to said bore entry, said block being shaped externally to form a guide chute and being angularly movable between a loading position in which said guide chute is aligned with said bore entry and said entry is exposed for a pellet to be inserted manually into position in said entry and a firing position in which said breech block completes a connection passageway for gas between said cylinder bore and said bore entry, said breech block being rotatably mounted in a rotary bearing surface provided by a forward extension of said cylinder bore so as to form a cylinder head for said cylinder bore.

* * * * *